United States Patent [19]

Huhn et al.

[11] 4,423,092

[45] Dec. 27, 1983

[54] LUBRICATING COMPOSITIONS FOR ORGANIC FIBERS

[75] Inventors: Karl Huhn; Helga Lampelzammer; Wolfgang Kaiser, all of Burghausen, Fed. Rep. of Germany

[73] Assignee: Wacker-Chemie GmbH, Munich, Fed. Rep. of Germany

[21] Appl. No.: 328,976

[22] Filed: Dec. 9, 1981

[30] Foreign Application Priority Data

Jan. 13, 1981 [DE] Fed. Rep. of Germany ..... 3100803

[51] Int. Cl.[3] ..... B05D 3/02

[52] U.S. Cl. ..... 427/316; 252/8.8; 252/8.9; 427/366; 524/912

[58] Field of Search ..... 252/8.6, 8.8, 8.9, 9; 8/115.6; 427/393.1, 387, 316, 359, 363, 365, 422, 434.4, 366, 434.6, 428; 524/912

[56] References Cited

U.S. PATENT DOCUMENTS 4,182,682 1/1980 Koerner et al. ..... 252/8.6

4,309,478 1/1982 Huber et al. ..... 252/8.6 X

FOREIGN PATENT DOCUMENTS

49/415513 11/1974 Japan ..... 427/393.1

*Primary Examiner*—Thurman K. Page

[57] ABSTRACT

A lubricating composition to improve the sliding properties of organic fibers comprising an organosilicon compound having at least one $OSiR_2$ unit and a compound selected from the group consisting of $$O{=}P[(OCHR^1CHR^1)_nOR^2]_3,\ NR_4^{2+}x^-$$

and mixtures thereof, where R is a hydrocarbon radical or a substituted hydrocarbon radical, $R^1$ represents hydrogen or the methyl group, with the proviso that in each —$OCHR^1CHR^1$ unit at least one $R^1$ must be hydrogen, $R^2$ represents hydrogen or a monovalent hydrocarbon radical having from 1 to 20 carbon atoms, with the proviso that in each compound of the formula $NR_4^{2+}x^-$ at least two of the $R^2$ radicals must represent hydrocarbon radicals, n is either O or an integer having a value of from 1 to 15, with the proviso that when $R^2$ is hydrogen in each of the phosphorus compounds, n must be at least 1 and that at least one —$OCHR^1CHR^1$ unit must be present in each of the phosphorus compounds and $x^-$ represents an anion of an organic or inorganic acid. These compounds not only improve the sliding properties of organic fibers, but also impart antielectrostatic properties to the treated fibers.

5 Claims, No Drawings

LUBRICATING COMPOSITIONS FOR ORGANIC FIBERS

The present invention relates to organic fibers having improved slip properties and more particularly to lubricating compositions which may be applied to organic fibers to improve the slip or sliding properties of the organic fibers.

BACKGROUND OF THE INVENTION

Organosilicon compounds containing at least one $OSiR_2$ unit and at least one group of the formula $$-X_aArX_aAr-$$

per molecule have been described in British Pat. No. 1,569,243 to Wacker-Chemie GmbH to improve the slip or sliding properties of organic fibers, where R is a hydrocarbon radical or a substituted hydrocarbon radical having from 1 to 10 carbon atoms and X represents a member selected from the group consisting of $$-\overset{O}{\overset{\|}{C}}-,$$

$$-NR'-, -O-, -S-, -SO_2-, -R''-, -NR'R''-,$$

$$-\overset{O}{\overset{\|}{C}}R'',$$

$-OR''-$, $-SR''-$, $-SO_2R''-$, where R' is hydrogen or has the same meaning as R, R'' represents a bivalent aliphatic hydrocarbon radical having from 1 to 8 carbon atoms, Ar represents a bivalent, aromatic hydrocarbon radical or a bivalent substituted aromatic hydrocarbon radical and a represents 0 or 1. Also, the British patent discloses that antistatic agents such as partial esters of laurylphosphoric acid may be used in these compositions to impart antielectrostatic properties to the treated fibers.

Also, U.S. Pat. No. 3,983,272 to Huber et al disclose a composition which is capable of imparting lubricating and antistatic properties to organic fibers containing a diorganopolysiloxane, a phosphorus compound and paraffin waxes, if desired.

Compared to the partial esters of laurylphosphoric acid and the other antistatic agents, such as the phosphorus compounds disclosed in U.S. Pat. No. 3,983,272 to Huber, the antistatic agents of this invention exhibit certain advantages. For example, they do not show any evidence of corrosion on metals and they are easily miscible with the organosilicon compounds used in this invention. Moreover, these antistatic agents impart a higher degree of antielectrostatic properties to organic fibers treated therewith than the antistatic agents used heretofore.

Therefore, it is an object of this invention to provide a composition which will impart lubricating properties to organic fibers treated therewith. Another object of the present invention is to provide a composition which will impart antistatic properties to organic fibers. Still another object of this invention is to provide organic fibers having improved slip or sliding properties. A further object of this invention is to provide organic fibers having improved antielectrostatic properties.

SUMMARY OF THE INVENTION

The foregoing objects and others which will become apparent from the following description are accomplished in accordance with this invention, generally speaking, by providing a composition which will improve the slip properties of organic fibers treated therewith comprising at least one organosilicon compound having at least one $OSiR_2$ unit and at least one group per molecule of the formula $$-X_aArX_aAr-,$$

where R represents the same or different hydrocarbon radicals or substituted hydrocarbon radicals having from 1 to 10 carbon atoms, X represents the same or different members of the group consisting of $$-\overset{O}{\overset{\|}{C}}-,$$

$$-NR'-, -O-, -S-, -SO_2-, -R''-, -NR'R''-,$$

$$-\overset{O}{\overset{\|}{C}}R''-,$$

$-OR''-$, $-SR''-$, $-SO_2R''-$,

R' is hydrogen or the same as R, R'' represents a bivalent aliphatic hydrocarbon radical having from 1 to 8 carbon atoms, Ar represents the same or different bivalent aromatic hydrocarbon radicals or substituted aromatic hydrocarbon radicals and a is 0 or 1, and at least one compound selected from the group consisting of $$O{=}P[(OCHR^1CHR^1)_nOR^2]_3,\ NR_4^{2+}x^-$$

and a mixture consisting of at least one such phosphorus compound and at least one such ammonium compound, where $R^1$ represents hydrogen or the methyl group, with the proviso that in each $-OCHR^1CHR^1$ unit at least one $R^1$ is hydrogen, $R^2$ is hydrogen or a monovalent hydrocarbon radical having from 1 to 20 carbon atoms, with the proviso that in each compound of the formula $NR_4^{2+}x^-$ at least two of the $R^2$ radicals are hydrocarbon radicals and n represents 0 or an integer of from 1 to 15, with the proviso that when $R^2$ is hydrogen in each of the phosphorus compounds n must be at least 1 and that at least one $-OCHR^1CHR^1$ unit must be present in each of the phosphorus compounds and $x^-$ represents an anion of an organic or inorganic acid. Other substituents which may be present in the composition of this invention are compounds which impart antielectrostatic properties and paraffin waxes.

DETAILED DESCRIPTION OF THE INVENTION

Organosilicon compounds which may be employed in the composition of this invention may be represented by the following general formula $$M_aR_bSi\{[(OSiR_2)_xD]_m(OSiR_2)_xOSiR_{3-a}m_a\}_{4-a-b}$$

where R and a are the same as above. In the above formula, D represents the same or different radicals having the formula $$-X_aArX_a(ArX_a)_c-,$$

where X, Ar and a are the same as above and c represents 0 or an integer having a value of from 1 to 5. In the above formula M represents the same or different radicals of the formula $$-X_aArX_a(ArX_a)_cH,$$

where X, Ar, a and c are the same as above, b is 0, 1, 2 or 3, m is 0 or an integer having a value of from 1 to 20 and x is 0 or an integer having a value of from 1 to 1,000, with the proviso that at least one $OSiR_2$ unit and at least one $$-X_aArX_aAr-$$

group is present per molecule.

The organosilicon compounds represented by the above formula also includes organosilicon compounds represented by the following formulas:

$$R_aSi[(OSiR_2)_xD]_m(OSiR_2)_xM_{4-a},$$

$$R_aSi[(OSiR_2)_xD]_mOSiR_{3\ 4-a},$$

$$MR_2Si[(OSiR_2)_xD]_m(OSiR_2)_xM,$$

$$R_3Si[(OSiR_2)_xD]_mOSiR_3,$$

where R, D, M, a, x and m are the same as above.

It is preferred that the number of $M_aR_bSi$ units, where the sum of a+b is 0 or 1, represent no more than about 20 mol percent and more preferably no more than about 10 mol percent of the siloxane units present in the organosilicon compounds represented in the above formulas.

Because they are readily available, it is preferred that at least 50 percent of the number of the R radicals be methyl radicals. Additional examples of hydrocarbon radicals represented by R are alkyl radicals such as the ethyl, n-propyl, isopropyl, n-butyl, sec-butyl, n-pentyl and sec-pentyl radicals, and aryl radicals such as the phenyl radical. Examples of substituted hydrocarbon radicals represented by R are halogenated hydrocarbon radicals such as the 3,3,3-trifluoropropyl radical and o-, p- and m-chlorophenyl radicals, as well as hydrocarbon radicals which are substituted by at least one amino group, such as N-beta-aminoethyl-gamma-aminopropyl radicals.

A preferred example of an Ar radical is the phenylene radical. When the Ar radicals are bivalent substituted aromatic hydrocarbon radicals, then the substituents may, for example be halogen atoms such as chlorine atoms; alkyl radicals such as the tert-octyl radical; alkaryl radicals such as tolyl radicals; alkenyl radicals such as the vinyl radical; hydroxyl groups, hydrocarbonoxy groups and/or amino groups.

Preferred examples of alkyl radicals represented by R'', which may be straight-chain, branched or cyclic, are the methylene and the isopropylene radicals.

Examples of radicals represented by D are those having the following formulas:

$-C_6H_{4-p}R_p'''-$, -p-$(CH_2)_2C_6H_{4-p}R_p'''-(CH_2)_2-$, $-o-OC_6H_{4-p}R_p'''C(CH_3)_2C_6H_{4-p}R_p'''O-$, $-o-(CH_2)_3OC_6H_{4-p}R_p'''-$, $-C(CH_3)_2C_6H_{4-p}R_p'''O(CH_2)_3-$ $-o-OC_6H_4OC_6H_4O-$.

In the above formulas, R''' represents the methyl, methoxy, tert-butyl, tert-butoxy or tert-octyl radicals and p is 1, 2, 3 or 4.

Examples of suitable radicals represented by M are those have the following formulas:

$-C_6H_{5-p'}R_{p'}'''$, $-(CH_2)_3OC_6H_{5-p'}R_{p'}'''$, $-OC_6H_{5-p'}R_{p'}'''$, $-(CH_2)_2C_6H_{5-p'}R_{p'}'''$ and $-OC_6H_{4-p}R_p'''(CH_3)_2C_6H_{4-p}R_p'''OH$, where R''' and p are the same as above and p' is 1, 2, 3, 4 or 5.

It is preferred that the radicals represented by M and D, which are present in the organosilicon compounds employed in this invention be derived from monovalent and/or polyvalent phenols or biphenols.

Also, it is preferred that the organosilicon compounds used in this invention have a viscosity of from 50 to 1,000 mPa.s at 25° C. in order to obtain a uniform and relatively thin coating on the organic fiber.

Examples of hydrocarbon radicals represented by $R^2$ in the phosphorus or ammonium compounds of this invention having the formulas $$O{=}P[(OCHR^1CHR^1)_nOR^2]_3 \text{ or } NR_4^{2+}x^-,$$

are alkyl radicals such as methyl, ethyl and n-butyl, sec-butyl, tert-butyl and the 2-ethylhexyl radicals, as well as the amyl, dodecyl, lauryl, tetradecyl, stearyl, oleyl and octadecyl radicals; aryl radicals such as the phenyl radical; alkaryl radicals such as the tolyl and cresyl radicals; and aralkyl radicals such as the benzyl radical.

The miscibility of the phosphorus compounds used in this invention with the organosilicon compounds is surprising since trisalkylphosphine oxides and trialkylphosphates are generally not miscible with these organosilicon compounds under similar conditions.

Examples of organic acids or inorganic acids from which the anions represented by $x^-$ can be derived are acetic acid and hydrochloric acid.

Examples of phosphorus compounds used in accordance with this invention are oleylpolyethylene glycolphosphoric acid esters (tertiary) and lauryl polyethylene glycolphosphoric acid esters (tertiary).

An example of an ammonium compound used in accordance with this invention is dimethyldistearyl ammonium chloride.

It is preferred that the phosphorus compound or ammonium compound used in accordance with this invention or a mixture containing the phosphorus compound and ammonium compound be employed in a total amount of from 0.1 to 30 parts by weight for each 50 to 100 parts by weight of the organosilicon compound having an $-X_aArX_aAr$ group or groups.

In addition to the organosilicon compound having an $-X_aArX_aAr$ group and a phosphorus and/or ammonium compound, the composition of this invention may also contain other substances. Examples of such other substances are especially paraffin waxes. When paraffin waxes are employed, they are generally used in amounts of up to 50 parts by weight and more preferably in amounts of from 0.5 to 20 parts by weight for each 50 to 100 parts by weight of the organosilicon compound having an $-X_aArX_aAr$ group or groups. These paraffin waxes may be either natural or synthetic waxes. It is preferred that the paraffins be refined to various degrees and more preferably that the paraffins be half or fully refined. Also, mixtures of refined paraffin waxes may be used in the composition of this invention.

In order to obtain uniform impregnation of the fibers at the temperatures which are generally used in applying the lubricants to organic fibers, the melting point of the paraffin wax used in the composition of this invention is in the range of from about 30° C. up to a maximum of about 80° C. Melting points of from about 40° to 60° C. are preferred.

It is preferred that the composition of this invention be applied in an undiluted condition in order to eliminate any need for recovering solvents and to avoid separation of aqueous emulsions or uneven impregnation of the fibers. If desired, these agents may, however, also be applied in the form of aqueous emulsions or in the form of solutions in organic solvents such as di-n-butylether, aromatic hydrocarbons or chlorinated hydrocarbons or mixtures of such solvents.

The compositions of this invention may be applied to any organic fibers which have been treated or could have been treated heretofore with lubricants based on organosilicon compounds.

Examples of such fibers are those made of wool, cotton, rayon, hemp, natural silk, polypropylene, polyethylene, polyester, polyurethanes, polyamides, cellulose acetate and polyacrylonitrile, and mixtures of such fibers. It is preferred that the composition of this invention be applied to yarns. If desired, the organic fibers may, however, also be treated in the form of fleeces, mats or woven or knitted fabrics, including garments or parts thereof.

The composition of this invention may be applied to the fibers by any conventional means known in the art, for example, by spraying, immersion, coating, calendering or by running the fibers over an absorbent base which has been impregnated with the composition of this invention.

It is preferred that the composition of this invention be applied to the organic fibers at temperatures of from 15° to about 100° C.

Preparation of Organosilicon Compound "A"

Organosilicon compound "A" was prepared by heating and kneading for 30 minutes in a laboratory kneader about 400 g of an Si-bonded hydroxyl terminated dimethylpolysiloxane having a viscosity of 140 mPa.s at 25° C., 7 g of a trimethylsiloxy end-blocked dimethylpolysiloxane having a viscosity of 100 mPa.s at 25° C. and 0.05 ml of a 25 percent solution of $Cl_3PNPCl_2NPCl_3.PCl_6$ in methylene chloride.

The product was then heated to 120° C. and 20 g of a mixture containing 8 parts by weight of tert-octylphenol, 2 parts by weight of 2,2-bis-(4-hydroxyphenyl)-propane and 0.1 ml of the above described solution of a phosphorus nitrile chloride were added. The mixture was then kneaded for 30 minutes at 120° C. at about 1 bar (abs.). Kneading was continued for an additional 30 minutes at 120° C. at about 0.001 bar (abs.). Thereafter 0.3 ml of tert-octylamine was added to the mixture and kneaded for one hour while being heated to 120° C. at 0.001 bar (abs.). The residue of unreacted compounds containing hydroxyl groups bonded to aryl radicals was removed with a thin film evaporator. The product obtained was colorless, slightly cloudy and had a viscosity of 350 mPa.s at 25° C.

Preparation of Organosilicon Compound "B"

Organosilicon compound "B" was prepared in accordance with Example 4 of U.S. Pat. No. 3,896,032 to Stroh et al. It consisted of about 66.66 parts by weight of a trimethylsiloxy end-blocked dimethylpolysiloxane which has a viscosity of 100 $mm^2.s^{-1}$ at 25° C., 6.66 parts by weight of a trimethylsiloxy end-blocked dimethylpolysiloxane which has a viscosity of 250 $mm^2.s^{-1}$ at 25° C., 6.66 parts by weight of a trimethylsiloxy end-blocked dimethylpolysiloxane which has a viscosity of 500 $mm^2.s^{-1}$ at 25° C., 6.66 parts by weight of a trimethylsiloxy end-blocked dimethylpolysiloxane which has a viscosity of 1,000 $mm^2.s^{-1}$ at 25° C., 6.66 parts by weight of a trimethylsiloxy end-blocked dimethylpolysiloxane which has a viscosity of 2,000 $mm^2.s^{-1}$ at 25° C., and 6.66 parts by weight of a trimethylsiloxy end-blocked dimethylpolysiloxane which has a viscosity of 5,000 $mm^2.s^{-1}$ at 25° C.

Examples 1 through 4 and Comparison Examples

The lubricants prepared above and shown in the following table were applied to blue yarn consisting of triple-twisted polyester staple fiber in which 100 meters of untwisted yarn weights 1 gram, by passing the yarn over a roller which rotates in a tub filled with the lubricant. The yarn is then spooled with the aid of a cross bobbin winder (type "pramat-Junior K", manufactured by Sahm, Eschwege, West Germany). The amount of lubricant applied is determined by weighing.

The treated yarns were used to sew four layers at a time of a blue cotton fabric ("Jeans") on an industrial sewing machine (model "438" Pfaff) at the rate of 7,000 stitches per minute in conjunction with a thread tension meter (manufactured by Schmidt, Waldkraiburg, West Germany). The following table illustrates the thread tension as a measure of the degree to which the slidability of the thread was improved by the lubricants.

The table also shows the electrostatic charge which is generated when the coated yarn is drawn repeatedly through linen fabric.

In Example 3, the yarn is first treated with the mixture of Example 1 and then with the organosilicon compound of Example 2.

In comparison test V4, the yarn is first treated with the mixture of Example 1 and then with the organosilicon compound of Example 2.

TABLE

| | Organosilicon compound wt. %/type | Paraffin wax wt. % | Lubricant Phosphorus or ammonium compound, wt. %/type | Appearance at °C. | Viscosity in mPa.s at application temp. °C. | Absorption wt. % | Thread tension in g | Electrostatic Charge |
|---|---|---|---|---|---|---|---|---|
| Examples | | | | | | | | |
| 1 | 90/A | 0 | 10/OPP | Uniformly Cloudy/25 | 450/25 | 4.7 | 180–190 | — |
| 2 | 90/A | 0 | 10/LPP | Uniformly Cloudy/25 | 420/25 | 3.3 | 155–165 | — |
| 3 | (1) 80/A | 12 | 8/LPP | Uniformly | 60/75 | 4.9 | 155–170 | — |

TABLE-continued

| | Organo-silicon compound wt. %/type | Paraffin wax wt. % | Lubricant Phosphorus or ammonium compound, wt. %/type | Appearance at °C. | Viscosity in mPa.s at application temp. °C. | Absorption wt. % | Thread tension in g | Electrostatic Charge |
|---|---|---|---|---|---|---|---|---|
| | (2)100/A | 0 | 0/— | Cloudy/75 | 350/25 | 2.1 | | |
| 4 | 84/A | 9 | 7/DMSAC | Uniformly Cloudy/75 | 80/75 | 2.5 | 180–190 | — |
| Comparison Examples | | | | | | | | |
| V1 | 90/A | 0 | 10/TEP | 2 phases/25 | 320/25 | 3.0 | 160–180 | + |
| V2 | 80/A | 10 | 10/TOPO | Hetergeneous at 75° C., cannot be applied | | | | |
| V3 | 80/B | 10 | 10/TOPO | 2 phases/75 | 60/75 | 3.7 | 250–290 | + |
| V4 | (1) 82/B | 8 | 10/APP | Clear/75 | 25/75 | 3.8 | 230–260 | — |
| | (2)100/A | 0 | 0/— | Clear/25 | 350/25 | 2.4 | | |

SYMBOLS
— no electrostatic charge
− slight electrostatic charge
+ moderate electrostatic charge
++ strong electrostatic charge
OPP = an oleylpolyethylene glycol phosphoric acid ester (tertiary) containing an average of 8 $—CH_2CH_2O$ usits per oleylpolyoxyethylene group.
LPP = a laurylpolyethylene glycol phosphoric acid ester (tertiary) of the formula $$HO(CH_2CH_2O)_yP(=O)(OCH_2CH_2)_zOH\,(OCH_2CH_2)_2OL$$

where L represents the lauryl radical and the sum of y + z equals 7.
DMSAC = dimethyldistearyl ammonium chloride
TOPO = trisoctylphosphinoxide
TEP = triethyl phosphate
APP = amylphosphoric acid partial ester The paraffin wax has a melting point which ranges from 52° to 54° C.

What is claimed:

1. A composition to improve the slip properties of organic fibers which comprises at least one organosilicon compound of the formula $$M_aR_bSi\{[(OSiR_2)_xD]_m(OSiR_2)_xOSiR_{3-a}M_a\}_{4-a-b}$$

where R is selected from the group consisting of hydrocarbon radicals and substituted hydrocarbon radicals having from 1 to 10 carbon atoms, D is a radical of the formula $$—X_a—ArX_a(ArX_a)_c—$$

where X is selected from the group consisting of $$—\overset{O}{\overset{\|}{C}}—,$$

$$—NR'—, —O—, —S—, —SO_2—, —R''—, —NR'R''—,$$

$$—\overset{O}{\overset{\|}{C}}R''—,$$

$—OR''—$, $—SR''—$, and $—SO_2R''—$, R' is hydrogen or R, R'' is a bivalent aliphatic hydrocarbon radical having from 1 to 8 carbon atoms, Ar is selected from the group consisting of a bivalent aromatic hydrocarbon radical and a substituted bivalent aromatic hydrocarbon radical, M is a radical of the formula $$X_aArX_a(ArX_a)_cH,$$

a is 0 or 1, b is 0, 1 or 2, c is 0 or a number of from 1 to 5, m is 0 or an integer having a value of from 1 to 20 and x is 0 or an integer having a value of from 1 to 1000, with the proviso that at least one $OSiR_2$ unit and at least one $—X_aArX_aAr—$ group is present per molecule and at least one compound selected from the group consisting of a phosphorus compound of the formula $O{=}P[(OCHR^1CHR^1)_nOR^2]_3$ and a mixture of the phosphorus compound and an ammonium compound of the formula $NR_4^{2+}x^-$, where $R^1$ is selected from the group consisting of hydrogen and a methyl group, with the proviso that in each $—OCHR^1CHR^1$ unit at least one $R^1$ is hydrogen, $R^2$ is selected from the group consisting of hydrogen and a monovalent hydrocarbon radical having from 1 to 20 carbon atoms, with the proviso that in each ammonium compound having the formula $NR_4^{2+}x^-$, at least two of the $R^2$ radicals are hydrocarbon radicals and n represents 0 or an integer of from 1 to 15, with the proviso that when $R^2$ is hydrogen in the phosphorus compound, n must be at least 1 and at least one $—OCHR^1CHR^1$ unit must be present in the phosphorus compound and $x^-$ represents an anion selected from the group consisting of an organic and inorganic acid.

2. The composition of claim 1, wherein the phosphorus compound of the formula $$O{=}P[(OCHR^1CHR^1)_nOR^2]_3$$

is present in an amount of from 0.1 to 30 parts by weight for each 50 to 100 parts by weight of the organosilicon compound.

3. The composition of claim 1, wherein a mixture containing the phosphorus compound of the formula $O{=}P[(OCHR^1CHR^1)OR^2]_3$ and the ammonium compound of the formula $NR_4^2x^-$ is present in a total amount of from 0.1 to 30 parts by weight for each 50 to 100 parts by weight of the organosilicon compound.

4. The composition of claims 2, 3 or 1, wherein the composition also contains a paraffin wax.

5. A process for imparting sliding and antielectrostatic properties to organic fibers which comprises treating the organic fibers at a temperature of from 15° to 100° C. with a composition containing at least one organosilicon compound of the formula $$M_aR_bSi\{[(OSiR_2)_xD]_m(OSiR_2)_xOSiR_{3-a}M_a\}_{4-a-b}$$

where R is selected from the group consisting of hydrocarbon radicals and substituted hydrocarbon radicals having from 1 to 10 carbon atoms, D is a radical of the formula $$-X_a-ArX_a(ArX_a)_c$$

where Y is selected from the group consisting of $$-\overset{O}{\overset{\|}{C}}-,$$

$$-NR', -O-, -S-, -SO_2-, -R''-, -NR'R''-,$$

$$-\overset{O}{\overset{\|}{C}}R''-,$$

$-OR''-$, $-SR''-$, and $-SO_2R''-$, R' is hydrogen or R, R'' is a bivalent aliphatic hydrocarbon radical having from 1 to 8 carbon atoms, Ar is selected from the group consisting of a bivalent aromatic hydrocarbon radical and a substituted bivalent aromatic hydrocarbon radical, M is a radical of the formula $$X_aArX_a(ArX_a)_xH,$$

a is 0 or 1, b is 0, 1 or 2, c is 0 or a number of from 1 to 5, m is 0 or an integer having a value of from 1 to 20 and x is 0 or an integer having a value of from 1 to 1000, with the proviso that at least one $OSiR_2$ unit and at least one $-X_aArX_aAr-$ group is present per molecule and at least one compound selected from the group consisting of a phosphorus compound of the formula $O{=}P[(OCHR^1CHR^1)_nOR^2]_3$ and a mixture of the phosphorus compound and an ammonium compound of the formula $NR_4^{2+}x^-$, where $R^1$ is selected from the group consisting of hydrogen and a methyl group, with the proviso that in each $-OCHR^1CHR^1$ unit at least one $R^1$ is hydrogen, $R^2$ is selected from the group consisting of hydrogen and a monovalent hydrocarbon radical having from 1 to 20 carbon atoms, with the proviso that in each ammonium compound having the formula $NR_4^{2+}x^-$, at least two of the $R^2$ radicals are hydrocarbon radicals and n represents 0 or an integer of from 1 to 15, with the proviso that when $R^2$ is hydrogen in the phosphorus compound, n must be at least 1 and at least one $-OCHR^1CHR^1$ unit must be present in the phosphorus compound and $x^-$ represents an anion selected from the group consisting of an organic and inorganic acid.

* * * * *